United States Patent [19]

Rubash et al.

[11] Patent Number: 4,637,632

[45] Date of Patent: Jan. 20, 1987

[54] HOLDING DEVICE

[76] Inventors: Arlyn R. Rubash, 2908 W. Brookside Dr., Peoria, Ill. 61615; Duane R. Rubash, 684 Garys Dr., Antioch, Ill. 60002

[21] Appl. No.: 798,442

[22] Filed: Nov. 15, 1985

[51] Int. Cl.[4] ..... B42D 17/00; A47B 65/00

[52] U.S. Cl. ..... 281/45; 211/42; 211/43

[58] Field of Search ..... 281/45; 211/41, 42, 211/43, 46, 184, 45; 248/448, 449, 441.1, 456, 34.1, 34.2, 34.3, 34.4, 34.5

[56] References Cited

U.S. PATENT DOCUMENTS

| | | | |
|---|---|---|---|
| 73,215 | 8/1927 | Wessel . | |
| 216,515 | 1/1970 | Sankey | D33/3 |
| 241,295 | 9/1976 | Entin | D6/184 |
| 262,336 | 12/1981 | Barnstone | D6/106 |
| 423,647 | 3/1890 | Wells | 211/11 |
| 712,936 | 11/1902 | Jones | 211/184 |
| 1,598,467 | 8/1926 | Weeks . | |
| 1,750,576 | 3/1930 | Cubberley | 211/43 |
| 2,645,127 | 7/1953 | Parks | 211/184 |
| 2,684,765 | 7/1954 | Lowenstein, Jr. | 211/43 |
| 3,269,558 | 8/1966 | Hess | 211/184 |
| 3,425,565 | 2/1969 | Sprenger | 211/43 |

FOREIGN PATENT DOCUMENTS

| | | | |
|---|---|---|---|
| 22741 | 6/1983 | Fed. Rep. of Germany | 211/43 |
| 784452 | 7/1935 | France | 211/42 |

*Primary Examiner*—Paul A. Bell
*Assistant Examiner*—Paul M. Heyrana, Sr.

[57] ABSTRACT

A stable, fixed locking relationship for a holding device is obtained through the use of two interlocking end members. The device may also be adjusted to provide the ability to hold differently sized objects.

10 Claims, 4 Drawing Figures

HOLDING DEVICE

BACKGROUND OF THE INVENTION

This invention pertains to a lockable device for holding or storing various objects such as books, computer units, and other like objects. The device may be adjusted in holding area to compensate for or to accommodate a variety of differently sized objects. The prior art contains devices which perform a holding function, however, none of such devices are believed to possess the unique combination of simplicity and flexibility exhibited by the device of this invention.

The prior art in this field appears to have followed at least three general patterns. The first pattern involves the use of two holding members which are spaced apart at a desired distance to accommodate an object or objects of a desired size. This approach is exemplified in U.S. Pat. No. 1,598,467; U.S. Pat. Nos. Des. 73,215; 216,515; and 262,336; and in German Pat. No. 22,741; issued on June 13, 1883. However, such devices do not provide for locking the two end members together to obtain a stable, fixed relationship. A second prior art approach pertains to holding devices which have a locked and potentially variable holding area. Such dual function is achieved by moving various intermediate holding members into fixed positions rather than by the simple and flexible manipulation of the locking end members of the present device. Typical of such prior art endeavors are U.S. Pat. Nos. 423,647; 712,936; 2,645,127; and 3,269,558. A third type of prior art holding device involves the use of a third member to connect the two end holding members. Such devices are normally both lockable and adjustable but do not possess the simplicity of operation of the present invention. Typical examples of these prior art devices may be found in U.S. Pat. Nos. 3,425,565 and Des. 241,295.

The problem of holding objects such as books is a long standing problem in the art that has been addressed by many practitioners as discussed above. It was not believed to be possible to obtain stability of the prior art holding devices without resorting to use of unlocked, relatively massive or unnecessarily complicated holding devices. An example of this problem is illustrated by the extremely wide variety of bookends utilized in the past. For example, measures such as stability promoting anti-friction layers, i.e., felt bottoms, were used to minimize separation of the bookends when in use.

The separation problem is addressed by exceedingly complicated locking arrangements in the prior art. Others attempted to solve the stability problem by developing a device which comprised a single non-adjustable unit. These single member or unitary devices lack the ability to be adjusted to accommodate varying sized objects. Furthermore, unitary devices have the additional disadvantage of a design which normally prevented close positioning of the device against the walls of adjacent desk or other verticle partitions due to the design of the unit.

As will be appreciated by those skilled in the art, the device of the invention is also superior to the prior art in that relatively simple manufacturing methods may be employed to produce the two end members. For example, each member may be readily produced from a single starting unit with use of a minimum number of stamping and forming steps and without the need for elaborate secondary operations.

SUMMARY OF THE INVENTION

This invention involves at least two embodiments which capitalize upon a similar principle; i.e., the use of two interlocking end or holding members which may be made to hold an object or objects of differing dimensions in a fixed, stable relationship.

The first embodiment pertains to the use of a device which comprises a first holding member having a surface adapted to be placed into holding contact with the object desired to be held. This member also contains an insert portion. The insert portion is structurally adapted to be inserted into an opening of a second member and then placed or repositioned in locking relationship with such second holding member. The insert portion is locked to the second holding member at a locking area following repositioning. The second holding member also has a surface adapted to be placed into holding contact with the object thereby providing two surfaces to hold the object. The second member has an opening structured to contain a distance that is greater than the largest width of the insert portion to permit the insert portion to be inserted into the opening of the second member and then to be repositioned following insertion so as to engage the locking area of the first member with a perimeter portion of the second member at the locking area thereby creating a stable, fixed locking relationship. The essence of the locking relationship is that the insert portion of the first holding member is inserted into an opening of the second member at a dimensional location which is greater than the width of the insert member. The insert member is then repositioned to enable the locking area of the insert member to be restrained by and locked with a different portion of the opening than where insertion was accomplished.

The second embodiment of the invention utilizes a holding device which comprises a first holding member having a surface adapted to be placed into holding contact with the object desired to be held. This member has a connecting portion which contains a locking opening sized so as to be capable of being placed into locking relationship with a second holding member. The device also has a second holding member containing a surface adapted to be placed into holding contact with the object thereby creating two holding surfaces. The second member contains a raised area which is capable of being inserted into the locking opening thereby preventing withdrawl of said first member and creating a stable, fixed locked relationship between the respective holding members.

DETAILED DESCRIPTION OF THE INVENTION

The operation of the invention and its preferred embodiments are described below in connection with a discussion of the various figures.

Figures 1, 2:
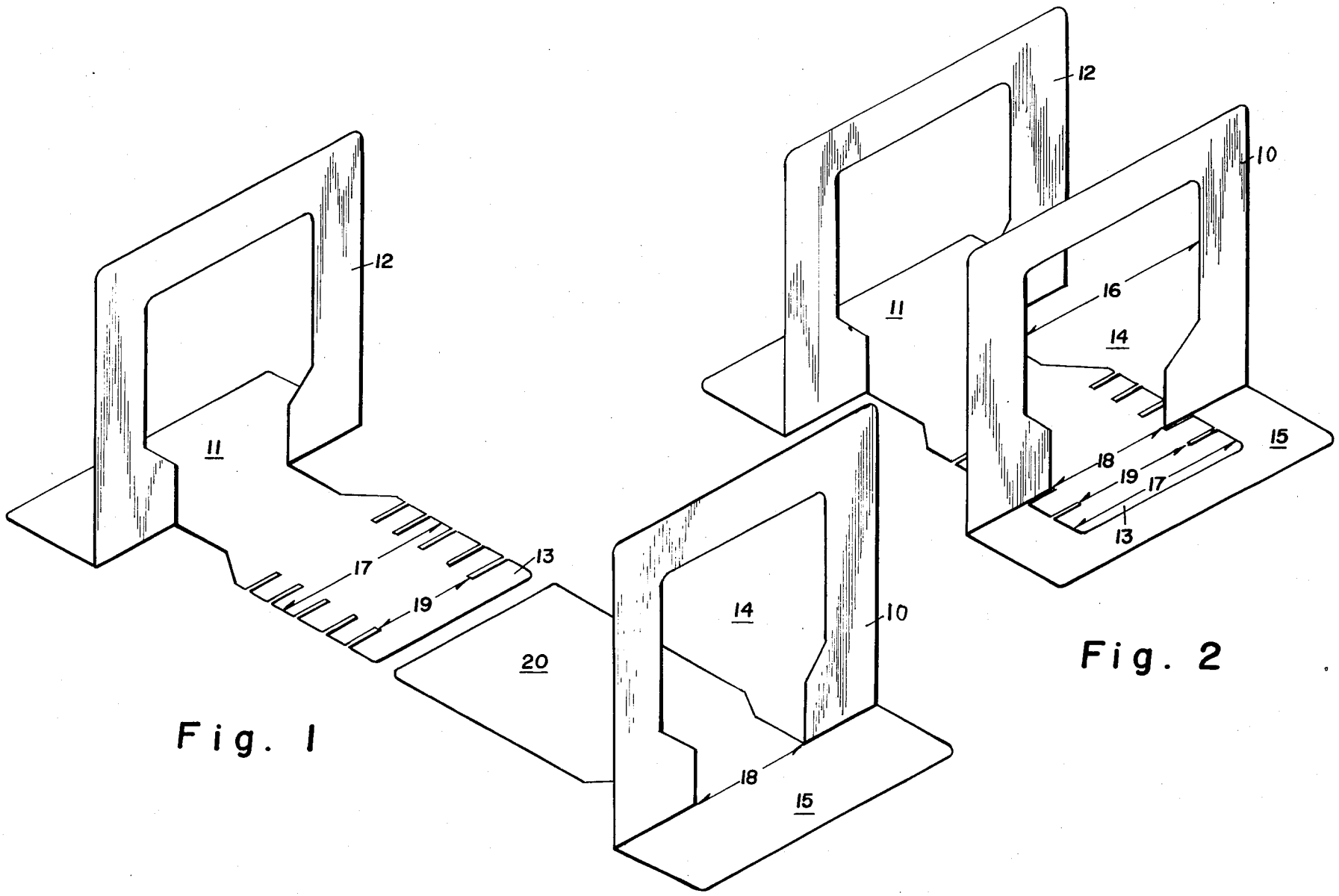
FIG. 1 is a pictorial view which illustrates the two end members prior to their being placed into locking relationship.
FIG. 2 is a pictorial view which illustrates the two end members following their placement into locking relationship.

FIG. 1 is a pictorial view which illustrates two end members prior to being placed into locking relationship. The holding device comprises first holding member 11 having vertical surface 12 which is adapted to hold an object. End member 11 has insert portion 13 that is to be inserted into opening 14 of second end member 15 to ultimately result in a stable, fixed locking relationship between the respective end members. Opening 14 is structured so that at least one configuration or dimension 16 which is greater than the largest width 17 of insert portion 13. To enable the respective end members to be locked, one simply inserts portion 13 at distance 16 and then repositions the rotating member by lowering the insert member to place insert 13 at the locking position of member 15 at locking area 18. This creates a fixed, stable locking relationship by placing grooved area 19 at locking area 18. Extended portion 20 of second end member 15 lies below insert member 13 following locking. Of course, the inclusion of extended portion 20 is not an essential portion of the invention.

As may be observed, multiple grooves may be provided in insert member 13 to provide for adjustability. Of course, an opening in first end member 11 is not required and is merely provided for symmetrical design purposes.

As may also be observed in FIG. 1, respective holding surfaces 12 and 10 are essentially parallel following the establishment of a locking relationship with insert member 13 being essentially perpendicular to the holding surfaces.

It is also pointed out that the grooves are oppositely spaced apart and notch shape for convenience, but could be of any desired configuration that would result in a fixed, stable locking relationship. The multiplicity of notches provides for the ability to locate the holding surfaces at a desired distance to permit the device to be used for objects of different sizes.

FIG. 2 is a pictorial view which illustrates the two end members following placement into locking relationship. The numerals are the same as used in connection with the description of FIG. 1.

Figure 3:
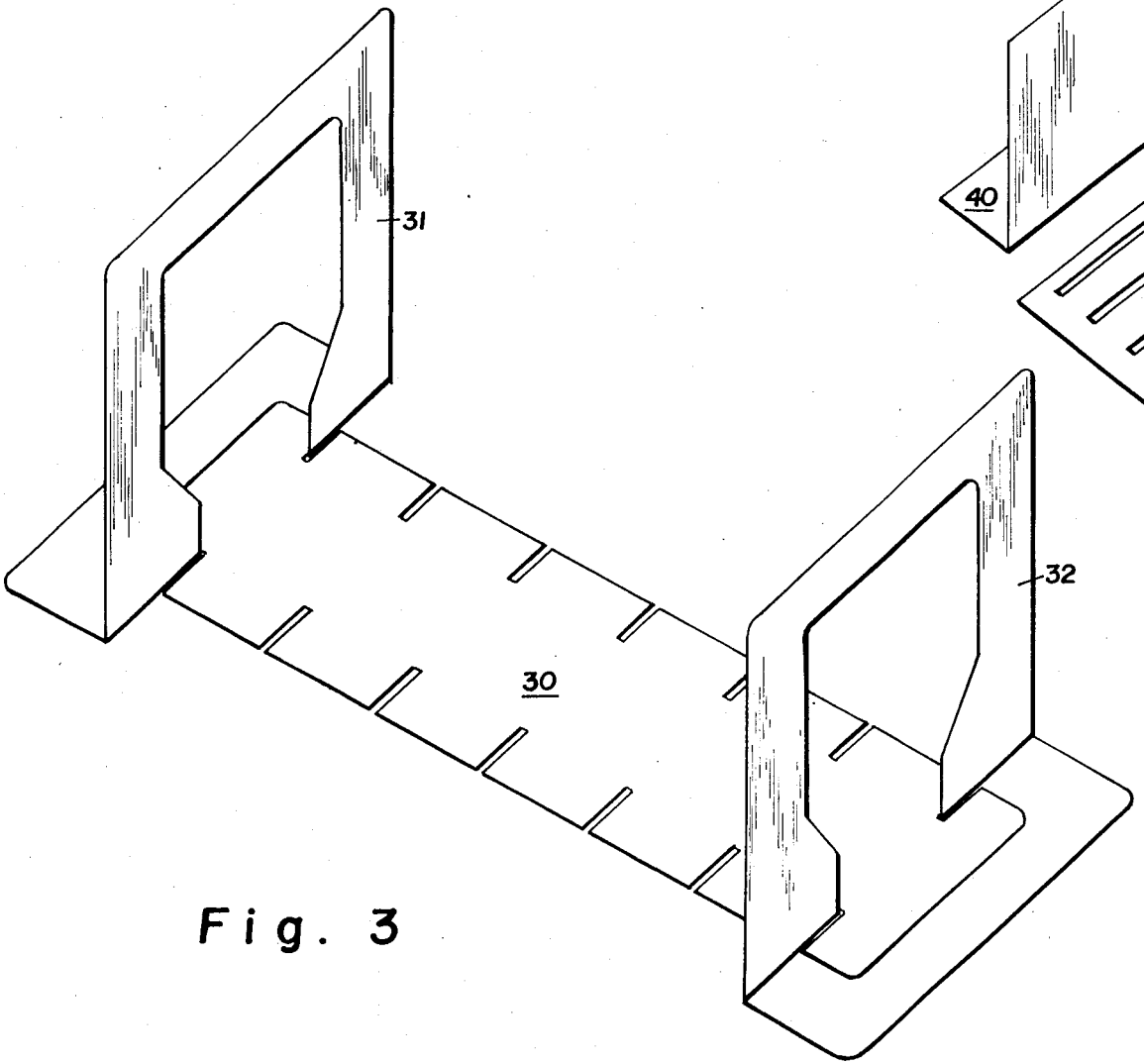
FIG. 3 is a pictorial view which illustrates a variant of the embodiment of the invention shown in FIGS. 1 and 2 where a third or insert member is utilized to obtain the desired locking relationship. This view shows the various members following placement in locking relationship.

FIG. 3 is a pictorial view which illustrates a variant of the embodiment of the device shown in FIGS. 1 and 2. In this variant detachable insert member 30 is utilized to lock end members 31 and 32 together in the same fashion illustrated in connection with the above discussion of FIGS. 1 and 2. Insert member 30 may be of any desired length and has an adjustability feature due to the presence of multiple, spaced apart grooves.

Figure 4:
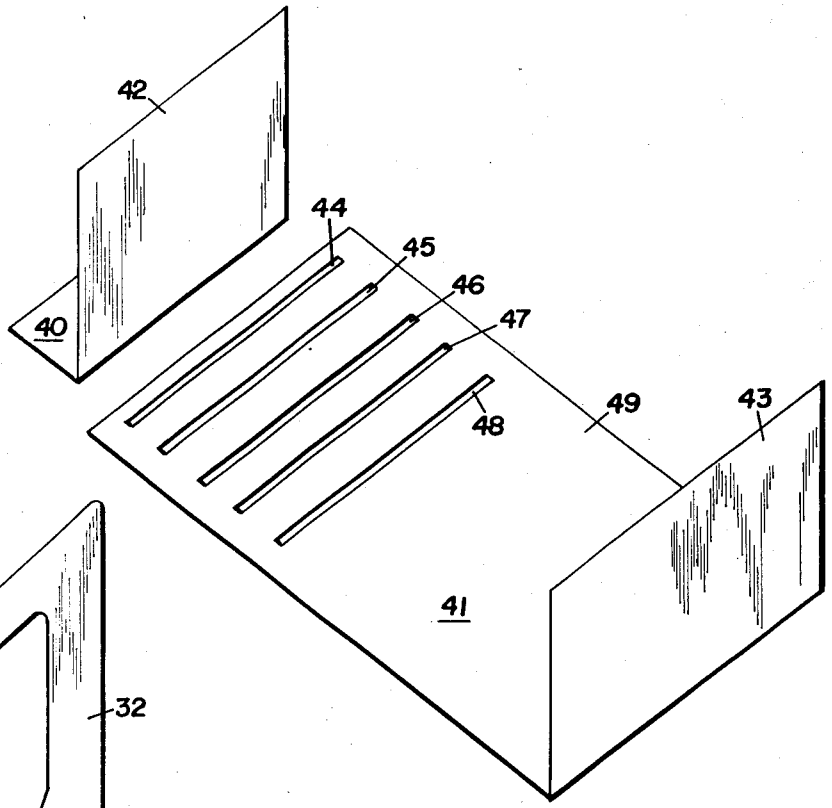
FIG. 4 is a pictorial view which illustrates another embodiment of the invention involving the use of a raised area to create the desired locking relationship.

FIG. 4 is a pictorial view illustrating another embodiment of the invention. This embodiment utilizes a raised area 42 to create the desired locking relationship between end members 40 and 41 by insertion into any of openings 44, 45, 46, 47, or 48. The holding device comprises first holding member 41 having holding surface 43 which is used to hold a side of an object. This member has connecting portion 49 which contains at least one locking opening, for example opening 44, which is sized or structured to be capable of being placed into a fixed, stable locking relationship with second end member 40. Second holding member 40 contains holding surface 42 which is intended to coact with holding surface 43 to hold an object. Holding surface 42 also constitutes a raised area which can be inserted into opening 44, for example, to create the desired locking relationship thereby performing a locking and holding function simultaneously. The selection of any of the illustrated locking openings for insertion of holding surface 42 creates a desirable adjustability of holding area.

We claim:

1. A device for holding at least one object in a stable, fixed position, comprising:

a. a first holding member having a surface adapted to be placed into holding contact with said object and having an insert portion having a first width that is its largest width, said first holding member being structurally adapted to be inserted into and placed in locking relationship with a second holding member, said insert portion containing a locking area having a locking area width; and b. a second holding member having a surface adapted to be placed into holding contact with said object and having an opening structured so as to contain a first distance that is greater than the first width of said insert portion and containing a second distance that is less than said first width but greater than the locking area width so as to enable said insert portion to be inserted into said opening at said first distance and then to be repositioned following said insertion at said locking area width so as to engage said locking area of said first member with a perimeter portion of said second member thereby creating a stable, fixed locking relationship between said first and second holding members.

2. The device of claim 1, wherein:

said holding surfaces of said first and second holding members are essentially parallel when locking relationship is established and said insert portion is essentially perpendicular to said holding surfaces.

3. The device of claim 1, wherein:

said locking area of the insert member contains at least one notch-like opening that results in a localized shortening of the width of said locking area to a width that is no longer than that of a second distance in the opening of the second holding member whereby said notched opening is capable of being placed in locking relationship with said second holding member.

4. The device of claim 3, wherein:

said locking area contains at least two notch-like openings spaced on opposite sides of said insert portion.

5. The device of claim 1, wherein:

said insert portion contains more than one locking area whereby said first and second holding members can be spaced apart and locked at varying distances from each other.

6. The device of claim 4, wherein:

said insert portion contains more than one locking area whereby said first and second holding members can be spaced apart and locked at varying distances from each other.

7. The device of claim 1, which further includes:

that said insert portion is detachable from said first holding member and may be locked to said first and second members in a similar manner.

8. A device for holding at least one object, comprising:

a. a first holding member having a surface adapted to be placed into holding contact with said object and having a connecting portion which contains a locking opening structured so as to be capable of being placed into locking relationship with a second holding member; and b. a second holding member having a holding surface adapted to be placed into holding contact with said object and having a raised area which area is the same as said holding surface and which is capable of being inserted into said locking opening thereby preventing withdrawal of said first member and thereby creating a stable, fixed relationship between said first and second holding members.

9. The device of claim 8, wherein:

said connecting portion contains more than one locking opening whereby said first and second holding members can be spaced apart and locked at varying distances from each other.

10. The device of claim 8, wherein:

said connecting portion contains more than one locking opening whereby said first and second holding members can be spaced apart and locked at varying distances from each other.

* * * * *